US008696162B2

(12) United States Patent
Wendt

(10) Patent No.: US 8,696,162 B2
(45) Date of Patent: Apr. 15, 2014

(54) LIGHTING SYSTEM, SPACE WITH A LIGHTING SYSTEM, AND METHOD OF PROVIDING AN ILLUMINATION PROFILE USING SUCH A LIGHTING SYSTEM

(75) Inventor: Matthias Wendt, Wurselen (DE)

(73) Assignee: Koninklijke Philips N.V., Eindhoven (NL)

( * ) Notice: Subject to any disclaimer, the term of this patent is extended or adjusted under 35 U.S.C. 154(b) by 220 days.

(21) Appl. No.: 13/263,923

(22) PCT Filed: Apr. 8, 2010

(86) PCT No.: PCT/IB2010/051525

§ 371 (c)(1),
(2), (4) Date: Oct. 11, 2011

(87) PCT Pub. No.: WO2010/119378

PCT Pub. Date: Oct. 21, 2010

(65) Prior Publication Data

US 2012/0033426 A1 Feb. 9, 2012

(30) Foreign Application Priority Data

Apr. 16, 2009 (EP) ..... 09158060

(51) Int. Cl.
*F21V 21/00* (2006.01)

(52) U.S. Cl.
USPC ..... 362/249.03; 362/249.07

(58) Field of Classification Search
USPC ..... 362/249.03, 249.07
See application file for complete search history.

(56) References Cited

U.S. PATENT DOCUMENTS

| | | | | |
|---|---|---|---|---|
| 7,726,839 | B2 * | 6/2010 | Chien | 362/249.03 |
| 7,862,206 | B2 * | 1/2011 | Chen et al. | 362/249.03 |
| 2003/0146719 | A1 | 8/2003 | Laerum et al. | |
| 2003/0193802 | A1 | 10/2003 | Luk | |
| 2005/0254263 | A1 | 11/2005 | Harwood | |
| 2008/0062689 | A1 | 3/2008 | Villard | |
| 2008/0068838 | A1 * | 3/2008 | Galke et al. | 362/250 |
| 2008/0266843 | A1 | 10/2008 | Villard | |

FOREIGN PATENT DOCUMENTS

| | | | |
|---|---|---|---|
| DE | 20211438 | U1 | 12/2003 |
| GB | 2372569 | A | 8/2002 |
| JP | 2005166426 | A | 6/2005 |
| WO | 03035991 | A2 | 5/2003 |
| WO | 2006060905 | A1 | 6/2006 |

* cited by examiner

*Primary Examiner* — Stephen F Husar
*Assistant Examiner* — James Cranson, Jr.
(74) *Attorney, Agent, or Firm* — Mark L. Beloborodov

(57) ABSTRACT

The invention provides a lighting system (1) comprising a plurality of elements (10) adjustably connected to a plurality of supports (11) arranged on a grid. Each of the plurality of elements (10) comprises a light source (L1). Each of the plurality of elements (10) further comprises at least two adjustable connections (12). The adjustable connections (12) connect the corresponding element (10) to respective supports (11) and adjustably position the corresponding element (10) relative to the respective supports (11). The invention further relates to a space comprising such a lighting system, a method of providing an illumination profile using such a lighting system and the use of such a lighting system for defining an illumination profile in a space.

12 Claims, 10 Drawing Sheets

LIGHTING SYSTEM, SPACE WITH A LIGHTING SYSTEM, AND METHOD OF PROVIDING AN ILLUMINATION PROFILE USING SUCH A LIGHTING SYSTEM

FIELD OF THE INVENTION

The invention relates to a lighting system, a space with such a lighting system, a method of providing, and a use for, an illumination profile using such a lighting system.

BACKGROUND OF THE INVENTION

Lighting in offices is usually provided as a combination of different types of lighting systems. For example, fluorescent lighting is installed in a ceiling as general illumination of the office, desktop lamps for providing individual task lighting for individuals working on a desk, and halogen spots are positioned on the ceiling or on the wall for providing spot lighting for pictures hanging on the wall. In this way, light is provided with both functional and decorative purposes. Most types of lighting systems are one-time installed, fixed installations. Some individual, standalone lamps may be adjustable, such as the desktop lamp.

An example of such a standalone adjustable lamp is described in US patent application US 2003/0193802 A1. This document describes a diode light source system for stage, theatre and architectural lighting including a plurality of separate flat panels for mounting a plurality of light emitting diodes emitting a plurality of diode light beams to a common focus area. A housing containing the panels has a centre base portion and a circular rim defining a housing aperture aligned with a circular rim plane having a rim plane centre arranged transverse to an axis aligned with the centre base portion. A screw arrangement positions the panels at a plurality of selected positions where each panel is oriented at a selected angle relative to the axis and the grouped diodes emit diode light beams transverse to each separate panel.

SUMMARY OF THE INVENTION

A disadvantage of many of the prior art systems is for instance that the illumination of the office is largely fixed by the available lighting installation, causing the positions of work spaces, e.g. office desks, in an office to be determined by the available lighting installation, rather than being determined for an effective use of office space area. Furthermore, users may not want to have to use additional light sources for task lighting, such as a desktop lamp which takes up desktop space.

Another disadvantage of the prior art is that the lighting pattern cannot be changed after the system has been installed. A specific disadvantage of some prior art lamps may be that their diode light source system only generates a single beam, and moreover offers a limited degree of flexibility, as it only allows varying the degree of convergence in the single beam in a pre-determined focus direction. Therefore, such lamps are in general useless for office lighting, let alone office lighting suitable for providing a combination of different types of light such as for instance general lighting and task lighting.

There is a desire for flexibility in the arrangement of the lighting in a room, especially on a ceiling, and particularly in a space with distributed working areas. It is a further desire to provide a versatile lighting arrangement, requiring a one-time installation while at the same time allowing illumination to be provided having different degrees of light concentration, e.g.

general illumination of a room and areas with concentrations of light for task lighting in working areas.

To achieve this, the invention provides, in a first aspect, an alternative lighting system comprising a plurality of elements adjustably connected to a plurality of supports arranged on a grid:

- each of the plurality of elements comprising a light source;
- each of the plurality of elements further comprising at least two adjustable connections, the adjustable connections connecting the corresponding element to respective supports and adjustably positioning the corresponding element relative to the respective supports.

In this way, a flexible lighting system is provided, as each of the plurality of elements comprising a light source can be individually positioned (adjusted) relative to the supports. When e.g. the lighting system is installed in an office having working areas with desks and open areas and corridors between the desks, a part of the plurality of the elements may e.g. be positioned to provide concentrated light to the working areas for obtaining an optimal light distribution at the desks, while the rest of the plurality of elements may be positioned to provide general illumination, e.g. at a background illumination level in the office and as illumination of the open areas and corridors. When the position of the desks in the office changes, the elements may be positioned differently to accommodate for the changed positions.

A further advantage may be that while the lighting system may be perceived as one light, some areas nevertheless may be more strongly illuminated than other areas (illumination profile). Hence, the lighting system may be arranged to provide an extended but substantially homogeneous light source (for instance as a ceiling light), which surprisingly illuminates some parts more strongly than others.

A further advantage may be that, no additional light sources for task lighting are needed in addition to the light sources for general lighting, as the lighting system according to the invention may provide both types of lighting with the same light sources. The lighting system according to the invention may efficiently accommodate both types of lighting, in terms of amount of light installed and total amount of power that is installed.

The lighting system may further comprise a plurality of other elements not comprising a light source. This may advantageously provide additional positioning freedom.

In a further embodiment, the adjustable connections are arranged to be movable along at least one of the respective supports. This may allow adjustably positioning each of the elements with at least one of its at least two adjustable connections relative to the respective supports in a convenient manner. The movement may e.g. be instantiated by pulling or pushing the element relative to the support. Moving all elements connected to one support in a pre-determined direction may e.g. correspond to providing a converging light beam, consisting of tilted light beams generated by each of the elements connected to the one support. In an embodiment, each of the adjustable connections of one element is arranged to be movable along the respective supports. In an alternative embodiment, one of the adjustable connections of one element is arranged to be movable along its respective support, while another one of the adjustable connections of one element is arranged to pivot with respect to its respective support while maintaining a fixed position along its respective support.

As will be clear to the person skilled in the art, embodiments may be combined.

In an embodiment, each of the plurality of elements extends from a first end of the respective element to at least a second end of the respective element, and the at least two adjustable connections are provided at the first end and at least the second end. Providing the adjustable connections at ends of the elements may allow obtaining a substantially seamless transition from one element to the next.

In an embodiment, the adjustable connections may be adjusted by hand by a person wishing to change the illumination profile generated by the lighting system during use.

In an embodiment, the lighting system comprises a plurality of actuators arranged for actuating corresponding adjustable connections, for adjustably positioning the corresponding elements relative to respective supports. The actuators may e.g. be arranged for moving the adjustable connections along the supports. The actuators may (independently) e.g. be selected from the group consisting of an electrical linear motor, a motor with screw gearing, a pneumatic motor, a linear piezo actuator, and a turn actuator. The use of actuators may allow a very precise positioning and thus a very accurate definition of the illumination profile. The actuators may cooperate to provide pre-determined illumination profiles in a convenient manner without a lot of manual adjustments. The lighting system may further comprise a controller electrically connected to the plurality of actuators, the controller being arranged for controlling the actuators for positioning the corresponding elements relative to respective supports according to one of a set of pre-determined conditions. The pre-determined conditions may e.g. have been programmed in a memory of the controller, e.g. by an expert operator, and one of the pre-determined conditions may be selected e.g. by any user, e.g. an office employee, or may be selected by the controller as a result of a sensor signal of a sensor, such as a (day)light sensor, thermal sensor, time sensor, etc.

In an embodiment, at least part of the adjustable connections are provided with a resilient element for compensating a change of distance in a direction along the element between corresponding supports when the corresponding elements are being adjustably positioned relative to respective supports. The resilient element may e.g. be a spring-like element. The use of a resilient element in between the element and the supports enables a rigid support to be applied while still allowing a substantial compensation of distance. The rigid support may e.g. conveniently also transfer heat away from the light source and/or supply the light source with power.

In an embodiment, the elements are extensible elements. The elements thus themselves accommodate a change in their length when being adjustably positioned relative to respective supports. The elements may e.g. be telescopic elements, or alternatively elastic elements.

As will be clear to the person skilled in the art, also combinations of adjustable connections provided with a resilient element and extensible elements may be applied in one lighting system.

In an embodiment, the plurality of elements are selected from the group consisting of bars, frames and boards. The choice between a bar, a frame or a board may depend on the required flexibility and/or the total number of light sources and elements and/or e.g. the allowable total weight of the lighting system. The use of a bar may e.g. be advantageous when a large number of individually adjustable elements are needed. Also, bars may provide a versatile type of elements when a plurality of differently sized and/or shaped lighting systems have to be provided, e.g. in different rooms or at different locations, allowing the use of a single type of element for each of the plurality of lighting systems. The use of boards may be advantageous e.g. when a large density of light sources needs to be provided, e.g. evenly distributed over the total area of the lighting system, as this enables light sources to be provided not only, on a line extending between one support and a next support, as would be the case with relatively narrow bars, but also at other positions on the area covered by the grid. The other positions may e.g. correspond to positions on the area extending between at least three adjacent supports, e.g. a triangular or square area extending between three or four adjacent supports on a triangular or square grid, respectively. The use of a frame, wherein a frame is substantially a plurality of, preferably rigidly-connected bars forming e.g. a triangle, a hexagon, a square, a star, or another suitably formed "open structure", may be advantageous for providing adjustments with additional degrees of freedom compared to the use of bars, in particular when the frame comprises at least three adjustable connections which are substantially individually adjustable. A frame may be manufactured using less material than a similarly-shaped board, which may be advantageous e.g. because of a lower weight and/or lower cost. All elements may be of the same type. Alternatively, elements of different types may be used in a single lighting system. A bar may also be referred to as a strip.

It is assumed that use is made of a bar, which may optionally be able to rotate around its longitudinal axis. The freedom in rotation may be partial freedom, for instance a rotation in a range of 0-180°, or a full 360° rotation.

In a further embodiment, at least part of the total number of the plurality of elements have a substantially regular polygon shape. The use of polygon shapes may advantageously allow substantially seamless transitions between elements. Polygon shapes may be selected and the elements may be arranged so as to provide the grid as a regular lattice. In an embodiment, a combination of two or more different types of polygons may be applied. In preferred embodiments, the grid comprises a regular lattice of either regular triangles, squares or hexagons. The ends of the element may be defined either by corners of the regular polygon shape or positions, e.g. mid positions, along sides of the regular polygon shape.

In an embodiment, the number of adjustable elements at ends of an element is smaller than the number of corners of the regular polygon shape. This reduces the number of adjustable elements, while still allowing a large degree of flexibility.

In an embodiment, at least two elements of the plurality of elements connect to a single support and share a common adjustable connection to the single support. As a result, the at least two elements of the plurality of elements are simultaneously adjusted when the common adjustable connection is being adjusted. When e.g. six elements of a plurality of bar-shaped elements are connected star-wise to a single support and share a common adjustable connection to the single support, adjusting the common adjustable connection may result in a focusing effect. The common adjustable connection of the at least two elements of the plurality of elements may further be advantageous in providing a smooth transition between neighboring elements.

In an embodiment, the light source comprises at least one light-emitting diode (LED). In an embodiment, at least some of the plurality of elements comprise a plurality of LEDs.

Solid state LEDs as light source(s) are especially desired because of their small dimensions and narrow beams. The term "plurality of light sources", such as a "plurality of LEDs" may refer to 2 or more light sources, especially 2-100,000 light sources, for instance 2-10,000, like 4-300, such as 16-256. Hence, the element or the lighting system may comprise a plurality of light sources, such as LEDs. In general, the element, or more especially, the lighting system, may comprise light sources such as LEDs at a density of 2-10,000 light sources/$m^2$, especially 25-2,500 light sources/$m^2$, wherein the density is measured relative to a total area covered by the lighting system. Note that the plurality of light sources, such as a plurality of LEDs, may be distributed over a plurality of elements. The term "lighting system" may also refer to a plurality of lighting systems.

The light source may comprise any light source, such as a small incandescent lamp or a fiber tip or fiber irregularity (arranged to allow light to escape from the fiber; which embodiment has the advantage that it is relatively cheap), but may especially comprise a LED (light emitting diode) (as a light source). A specific advantage of using LEDs is that they are relatively small and may therefore allow the arrangement of a large number of LEDs. Another specific advantage of using LEDs is that they may provide relatively narrow beams, allowing an accurate definition of the illumination profile generated by the lighting system. The term LED may refer to OLEDs, but especially refers to solid state lighting. Unless indicated otherwise, the term LED herein further refers to solid state LEDs.

In an embodiment, the LEDs are provided at a density of at least 1 LED per 100 $cm^2$. In a further embodiment, the LEDs are provided at a density of at least 1 LED per 10 $cm^2$. In an embodiment, the plurality of elements is at least 20. In an embodiment, the plurality of elements comprise in total at least 100 light sources. With such a relatively large density, such a number of elements and/or such a number of light sources, a large degree of flexibility is obtained. Moreover, a large number of LEDs allows the use of LEDs with a relatively low power dissipation, which may be advantageous from a thermal point of view. It will be appreciated that the number of LEDs used in the lighting system may be determined in dependency on e.g. required light level(s), type and characteristics (such as light output level, color of light, thermal characteristics and/or electrical operating parameters) of the LEDs and required degree of flexibility in the illumination profile generated from the lighting system.

In an embodiment, the light source(s) on the elements can be controlled for color and/or brightness. This may further improve the quality of the light. The color may e.g. be changed depending on the time of day, or on the type of work in the room. The color and/or brightness may be controlled by a controller in dependence on e.g. a sensor signal, a day and/or time of day, or an input of a user. The input of the user may e.g. be provided from a remote control unit operated by the user, the remote control unit being arranged to provide control signals to the controller in dependence on the input of the user to the remote control unit. The input of the user may be provided as a selection from a pre-determined plurality of pre-determined settings, or as a freely programmable setting wherein the input of the user is e.g. compiled from a plurality of settings provided by the user for the light sources.

A second aspect of the invention provides a space comprising a lighting system according to any one embodiment of the first aspect of the invention. The space may e.g. be a room, an office, a hallway, a corridor, a factory floor, or any other space in which an adjustment of lighting conditions without the need to re-install the lighting system in whole or in part may be expected. The space may in particular be a space with a plurality of working areas with individual lighting requirements. When such a space comprises a lighting system according to the invention, all working areas can be optimally illuminated without any re-installation being performed and without the need for additional lights, such as e.g. a desktop lamp. In further embodiments, the lighting system is arranged to illuminate a part of a wall of the space. This takes away the need for additional lighting units for perimeter wall lighting and may allow for a consistent illumination profile in the whole space. In an embodiment, the lighting system provides an illumination profile changing over a pre-determined time period from a first illumination profile to a second illumination profile. The changing may be repeated, providing a gradual cycling between two or more illumination profiles.

In an embodiment, the lighting system is attached to a ceiling of the space. The lighting system may be directly attached to the ceiling, or alternatively suspended from the ceiling. In general, the grid is attached to the ceiling.

In a further aspect, the lighting system further comprises a controller, which may be arranged external to the ceiling but which may also be integrated in the ceiling, arranged to control the lighting system, and especially the individual light sources of the lighting system. In this way, an illumination profile may be provided that is e.g. different at different times of the day, depending on the number of office workers and their positions and/or depending on the activities in the room (e.g. different between meetings and standalone working). One or more of color, on/off state, intensity and pattern shape of the light generated by the lighting system may be variable and may be controlled by the controller. Further, one or more of color, on/off state, intensity and pattern shape may be dependent on a sensor signal of a sensor (such as a touch, (day)light or approach sensor), wherein the sensor is arranged to sense an object in the room, and wherein the controller is arranged to control one or more of color, on/off state, intensity and pattern shape in dependence on the sensor signal.

In yet a further embodiment, the invention provides the lighting system in combination with a sensor and the controller, wherein the sensor is arranged to provide a sensor signal when the sensor is approached or touched, and wherein the controller is arranged to control one or more parameters selected from the group consisting of a lighting parameter (such as one or more of color, color distribution, light intensity, light intensity distribution, blinking frequency, etc.) of the generated illumination profile and pattern shape provided by the lighting system. Patterns or information will in general be provided by a plurality of light sources.

A third aspect of the invention provides an element for a lighting system according to the first aspect of the invention. Such an element may facilitate the installation of such a lighting system, and/or expand the lighting system with additional elements.

A fourth aspect of the invention provides a method of providing an illumination profile, using a lighting system according to the first aspect of the invention, the method comprising adjustably positioning at least two of the plurality of elements relative to the respective supports. The method provides a convenient manner of changing the illumination profile.

In a preferred embodiment, providing the illumination profile is associated with concentrating light generated by the light sources on part of the plurality of elements to a plurality of working areas. The working areas may e.g. correspond to office desks in an office, workbenches in a workshop, or individual working areas on a factory floor. Defining the illumination profile may be further associated with providing general illumination light. Providing the illumination profile may be associated with de-concentrating light generated by the light sources on part of the plurality of elements. This allows providing diffusely illuminated areas, e.g. corresponding to a corridor or an open area in e.g. an office, workshop or factory floor. Providing the illumination profile may be associated with slowly changing the illumination profile over a pre-determined time period from a first illumination profile to a second illumination profile.

A fifth aspect of the invention provides a use of a lighting system according to the first aspect of the invention, for defining an illumination profile in a space. The space may thus be provided with e.g. one or more parts of the space where light generated by the light sources on part of the plurality of elements is concentrated, preferably with a plurality of parts with concentrated light. The one or more parts of the space with concentrated light may thus be provided e.g. at different positions between different moments of use of the lighting system. The space may thus be provided with, e.g., one or more areas in the space where light generated by the light sources on part of the plurality of elements is de-concentrated, thus providing diffusely illuminated areas in the space. The one or more parts of the space with concentrated light may be associated with e.g. working areas in the space. In an embodiment, the lighting system further provides light directed to a wall of the space, for generating perimeter lighting without the need for installing additional light sources for illuminating the wall. Illuminating the wall with the same lighting system as used for general lighting and task lighting may be advantageous in defining a consistent illumination profile across the whole space.

Throughout this document, the terms "blue light" or "blue emission" especially relate to light having a wavelength in the range of about 410-490 nm. The term "green light" especially relates to light having a wavelength in the range of about 500-570 nm. The term "red light" especially relates to light having a wavelength in the range of about 590-650 nm. The term "yellow light" especially relates to light having a wavelength in the range of about 560-590 nm. The term "light" herein especially relates to visible light, i.e. light having a wavelength selected from the range of about 380-780 nm. Light emanating from the carpet, i.e. from the carpet tile top face, into a space over the carpet is herein also indicated as "carpet light".

Unless indicated otherwise, and where applicable and technically feasible, the phrase "selected from the group consisting of a number of elements" may also refer to a combination of two or more of the enumerated elements.

Terms like "below", "above", "top", and "bottom" relate to positions or arrangements of items which will be obtained when the lighting system is arranged substantially flat on a substantially horizontal surface, with the lighting system bottom face substantially parallel to the substantially horizontal surface and facing away from the ceiling and into the room. However, this does not exclude the use of the lighting system in other arrangements, such as against a wall, or in other (vertical) arrangements.

The phrase "a lighting system comprising a plurality of elements adjustably connected to a plurality of supports" and similar phrases may refer to embodiments wherein the actual number of elements is not identical to the actual number of supports. Herein, the term "adjustable connection" is used to indicate a connection between the element and the support that is adjustable.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
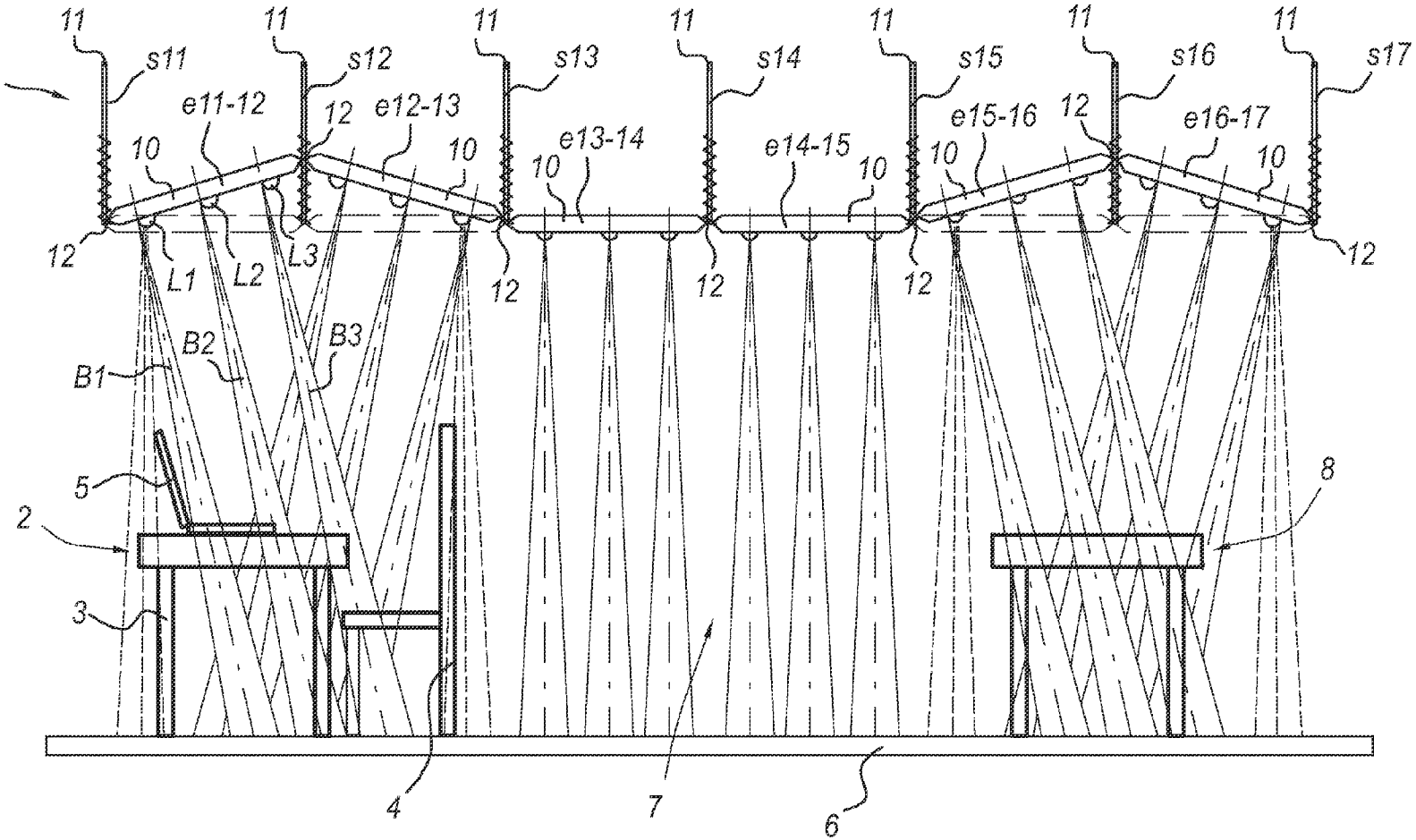
FIG. 1 schematically depicts an embodiment of a lighting system according to the invention.

FIG. 1 schematically depicts an exemplary embodiment of a lighting system 1 according to the invention, attached to a ceiling (not shown) of an office space (not shown). FIG. 1 shows two work spaces 2, 8 at different locations on the office floor 6 in the office space, separated by a corridor 7. Each work space has e.g. a desk 3 with a chair 4, and optionally a computer display 5 on the desk.

The lighting system 1 has a plurality of supports 11, individually numbered as s11, s12, s13, s14, s15, s16, s17. The supports 11 may be arranged on a grid (not shown) and extend down from the ceiling, or may be directly attached to or integrated in the ceiling. It will be understood that the grid may extend in two dimensions along the ceiling. The grid may e.g. correspond to a triangular or hexagonal lattice, as described further below.

Elements 10, individually numbered as e11-12, e12-13, e13-14, e14-15, e15-16, e16-17, are adjustably connected to the supports s11, s12, s13, s14, s15, s16, s17 by means of adjustable connections 12: element e11-12 connects to the two supports s11 and s12, element e12-13 connects to the two supports s12 and s13, etc. Each of the elements comprises at least one light source, in this example a plurality of light sources L1 (and L2 and L3), for providing light beams B1, B2 and B3. The light sources L1, L2, L3 may e.g. be LEDs. The elements 10 may comprise the light source L1, and since a plurality of elements 10 is provided, the lighting system comprises a plurality of light sources L1. Each element may, independently, comprise a plurality of light sources, indicated with for instance the references L1, L2, L3, etc.

The lighting system provides task lighting to work space 2 by positioning elements e11-e12 and e12-13 at angles relative to the respective supports s11, s12 and s13, thus directing the beams generated by the light sources on the elements to the work space 2. Light originating from elements e11-e12 and e12-13 is thus concentrated at the work space 2. Likewise, the lighting system provides task lighting to work space 8 by positioning elements e15-e16 and e16-17 at angles relative to the respective supports s15, s16 and s17, thus directing the beams generated by the light sources on the elements to the work space 5. The lighting system further provides general illumination over a part of the office space, in the example of FIG. 1 the corridor 7, by connecting elements e13-e14 and e14-15 so as to extend substantially perpendicularly to the respective supports s13, s14 and s15, i.e. substantially parallel to the office floor. An illumination profile may thus be defined and/or adjusted using the lighting system 1, by at least adjustably positioning at least two of the plurality of elements e11-12, e12-13, e13-14, e14-15, e15-16, e16-17 relative to the respective supports s11, s12, s13, s14, s15, s16, s17. Defining the illumination profile may be associated with concentrating light generated by the light sources L1, L2, L3, . . . on the plurality of elements e11-12, e12-13, e13-14, e14-15, e15-16, e16-17 onto a plurality of working areas 5, 8.

As will be clear to the person skilled in the art, the invention is not limited to the elements 10 and/or supports 11 and/or light sources L1-L3, etc., shown in the schematic drawings.

Figure 2:
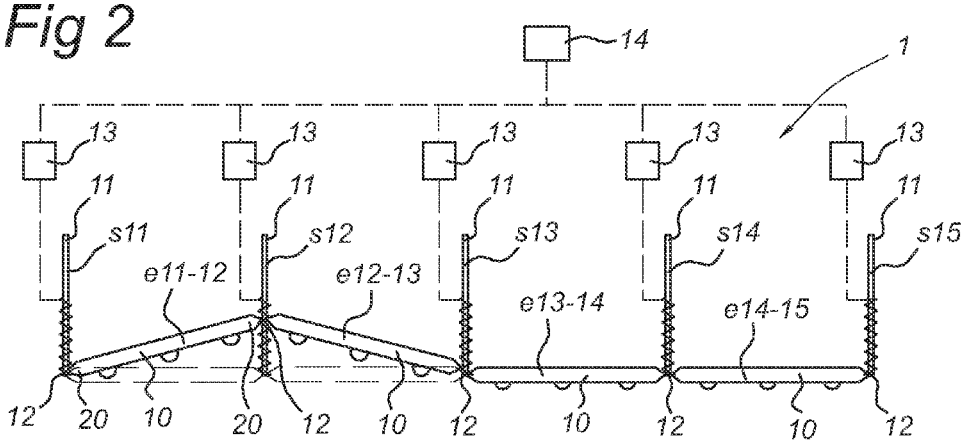
FIGS. 2-13*b* schematically depict embodiments and variants thereof of aspects of a lighting system according to the invention.

FIG. 2 schematically depicts exemplary embodiments of supports 11 (s11, s12, s13, s14, s15) and elements 10 (e11-12, e12-13, e13-14, e14-15) in a vertical cross-section of the lighting system 1. Element e11-12 is depicted in dashed lines in a first position relative to support s11, with one adjustable connection 12 at one end 20 of the element e11-12, and in the same first position relative to support s12, with another adjustable connection 12 at its other end 20, thereby positioning the element e11-12 substantially perpendicularly to the supports s11 and s12. Element e11-12 is depicted in full lines in a first position relative to support s11 and in a second position, different from the first, relative to support s12, thereby positioning the element e11-12 at an angle in between the supports s11 and s12. Likewise, an opposite angle is obtained for element e12-13, whereas elements e13-14 and e14-15 are each positioned in the first position relative to both corresponding supports s13, s14 and s14, s15 respectively.

FIG. 2 further shows an optional presence of actuators 13 for actuating the adjustable connections 12 for adjustably positioning the elements e11-12, e12-13, e13-14, e14-15 relative to respective supports 11 s11, s12, s13, s14, s15. In an embodiment, each adjustable connection 12 corresponds to connecting one element 10 to one support 11, e.g. one of the adjustable connections 12 connects element e11-12 to support s11, another of the adjustable connections 12 connects element e11-12 to support s12, yet another of the adjustable connections 12 connects element e12-13 to support s12, a further one of the adjustable connections 12 connects element e12-13 to support s13, etc. In an alternative embodiment, each adjustable connection 12 corresponds to a common adjustable connection for connecting two or more elements 10 to one support 11, e.g. one of the adjustable connections 12 connects element e11-12 as well as element e12-13 to support s12, another of the adjustable connections 12 connects element e12-13 and element e13-14 to support s13, etc. The use of common adjustable connections may be advantageous in that a smaller number of actuators is required compared to having one actuator per adjustable connection, and/or a smooth positioning transition is obtained between adjacent elements, as their positioning is coupled via the common adjustable connection. Further, one actuator 13 may also be arranged to adjustably position a plurality of elements 10.

FIG. 2 further shows an optional presence of a controller 14, for controlling the actuators 13. With such a controller 14, a centrally operated actuation of the adjustable connections 12 can be obtained e.g. under the control of a remote control unit that is operated by a user. Without such a controller 14, each adjustable connection 12 has to be individually adjusted.

Figure 3:
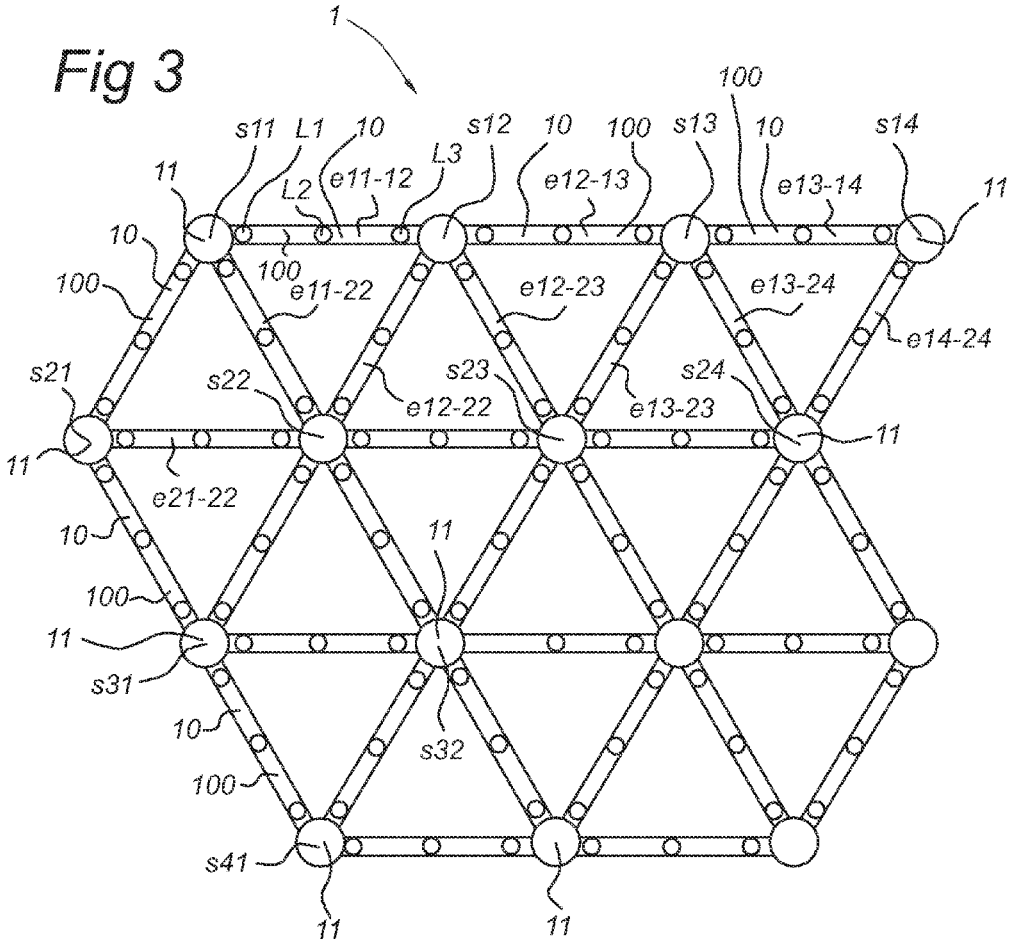

FIG. 3 schematically depicts a plane view of an exemplary lighting system 1, showing supports 11, numbered as s11, s12, s13, s14, s21, s22, s23, s24, s31, s32, s33, s34, s41, s42, s43, arranged in a hexagonal grid. In this example, the elements 10 are bar-shaped elements 100. It will be appreciated that the elements 10 may be shaped differently. Bar-shaped element e11-12 is connected with one end to support s11 and with its other end to support s12. Likewise, bar-shaped element e12-13 is connected with one end to support s12 and with its other end to support s13, etcetera. Thus, bar-shaped element e11-KL is connected with one end to support sIJ and with its other end to support sKL; that is to say, for example, for I=2, J=2, K=3, L=2, bar-shaped element e22-32 is connected with one end to support s22 and with its other end to support s32.

The (bar-shaped) elements may carry light sources, preferably LEDs. The plurality of elements is preferably at least 20, more preferably at least 50. The plurality of elements comprise in total preferably at least 20, more preferably at least 50, even more preferably at least 100 LEDs. The LEDs are preferably provided at a density of at least 1 LED per 100 $cm^2$, more preferably at a density of at least 1 LED per 50 $cm^2$, even more preferably at a density of at least 1 LED per 20 $cm^2$, even more preferably at a density of at least 1 LED per 10 $cm^2$, even more preferably at a density of at least 1 LED per 5 $cm^2$, wherein the density is measured relative to the area of the lighting system.

Figure 4A:
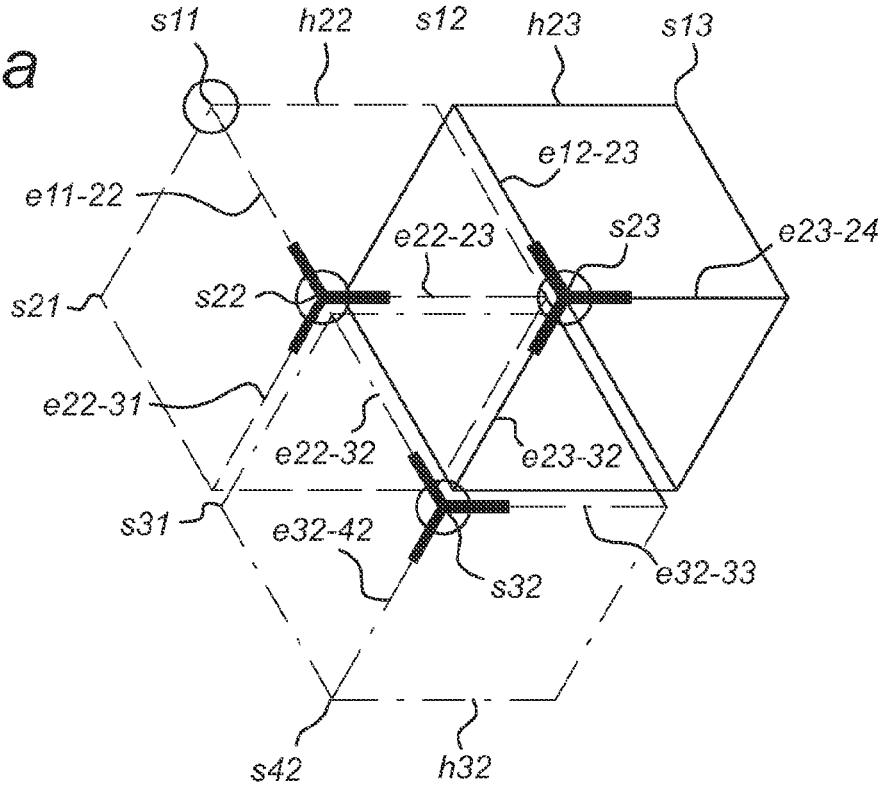

FIG. 4*a* shows a first variant of the lighting system of FIGS. 2 and 3. In this variant, hexagonal unit cells h22, h23, h32 are defined around respective supports s22, s23, s32. Three elements of each unit cell share a common adjustable connection, of which exemplary embodiments will be shown in further Figures below. E.g., in unit cell h22, elements e11-22, e22-23 and e22-31 share a common adjustable connection to support s22, with their ends connecting to the support s22. This allows adjusting a degree of convergence of the light generated from the light sources on the three elements e11-22, e22-23 and e22-31 to a point below the hexagonal cell h22, e.g. to a desk positioned substantially below it in an office space, by adjusting the position of a single adjustable connection only. Moreover, neighboring hexagonal cells h22, h23 and h32 overlap for providing a smooth illumination profile below the lighting system. By adjusting the other ends of the elements e11-22, e22-23 and e22-31 at the same positions relative to the respective supports s11, s23, s31, the resulting convergent beam is directed downward at right angles to the lighting system e.g. in a direction as shown for elements e11-s12 and e12-13 in FIG. 1. By adjusting the other ends of the elements e11-22, e22-23 and e22-31 at different positions relative to the respective supports s11, s23, s31, the resulting convergent beam can be directed downward at an angle relative to the lighting system. The direction of the resulting convergent beam thus is not limited to a single, pre-determined direction only.

Figure 4B:
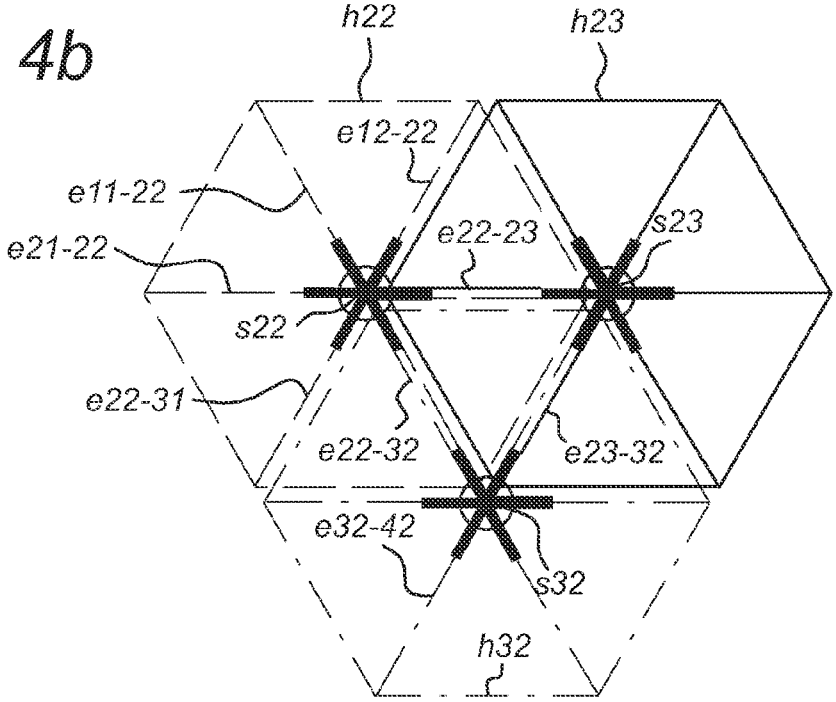

FIG. 4*b* shows a second variant of the lighting system of FIGS. 2 and 3. In this variant, hexagonal unit cells h22, h23, h32 are defined around respective supports s22, s23, s32. Six elements of each unit cell share a common adjustable connection. E.g., in unit cell h22, elements e11-22, e21-22, e22-23, e22-32, e22-31, e21-22, e11-22 share a common adjustable connection to support s22 with their ends connecting to the support s22. This allows adjusting a degree of convergence of the light generated from the light sources on the six elements e11-22, e21-22, e22-23, e22-32, e22-31, e21-22, e11-22 to a point below the hexagonal cell h22, e.g. to a desk positioned substantially below it in an office space, by adjusting the position of a single adjustable connection only. As neighboring hexagonal cells are now mechanically coupled, e.g. cell h22 and h23 are coupled via element e22-23, a smooth adjustment is provided between neighboring cells, and thus throughout the lighting system.

Preferably, the plurality of elements of the lighting system 1 are selected from the group consisting of bars, frames and boards. Examples are shown in the following Figures. The bars may for instance be straight or curved; the frames and boards may for instance be flat or bent.

Figure 5A:
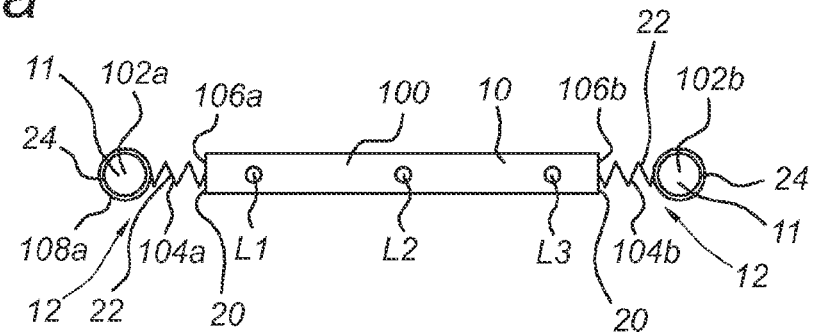
Figure 5B:
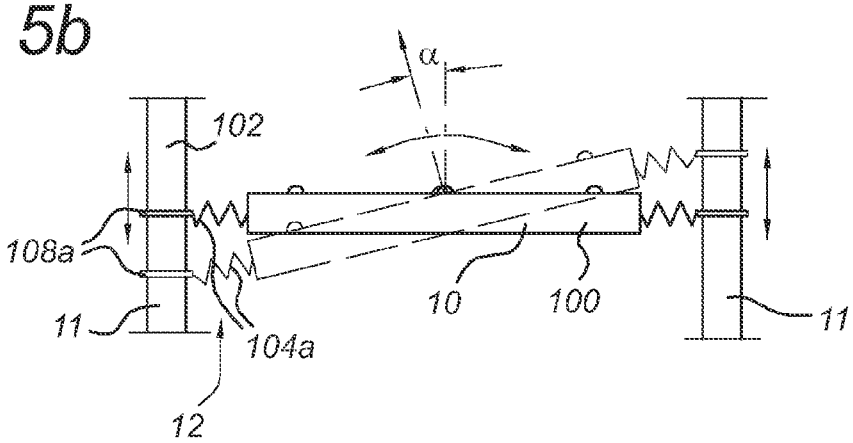

FIGS. 5*a* and 5*b* show a first variant of an element 10 with its adjustable connections 12 to respective supports 11 (shown as supports 102*a* and 102*b*). FIGS. 5*a* and 5*b* show an element 10 in the form of a bar-shaped element 100, carrying three light sources L1, L2, L3. The bar-shaped element 100 extends from a first end 20, individually numbered as 106*a*, to a second end 20, individually numbered as 106*b*. Adjustable connections 12 are provided at each end 20. In this example, each adjustable connection 12 comprises a resilient element 22 and a movable part 24. The first end 106*a* is connected with resilient element 22, individually numbered as 104*a*, and movable part 24, individually number as 108*a*, to its respective support 102*a*. The resilient element 104*a* and the movable part 108*a* thus provide the adjustable connection 12 to support 102*a*. Movable part 108*a* can be adjustably positioned along the support 102*a*. The second end 106*b* is connected with resilient element 22, individually numbered as 104*b*, and movable part 22, individually numbered as 108*b*, to its respective support 102*b*. The resilient element 104*b* and the movable part 108*a* b thus provide the adjustable connection 12 to support 102*b*. Movable part 108*b* can be adjustably positioned along the support 102*b*. By moving the movable parts 108*a* and 108*b* to different positions along the respective supports 102*a*, 102*b*, an angle α of the bar-shaped element 100 relative to both supports 102*a*, 102*b* can be adjusted.

Preferably, at least part of the total number of the plurality of elements have a substantially regular polygon shape. Examples are shown in the following Figures. For clarity, elements 10, ends 20, resilient elements 22, movable parts 24 and supports 11 are shown with specific and individual reference numbers, specific for each example shown. The relation between the general reference numbers 10, 20, 22, 24, 11 and the specific and individual reference numbers in the examples below will be clear from the description of FIG. 5*a* and FIG. 5*b* above, i.e. their context in the corresponding example.

Figure 6A:
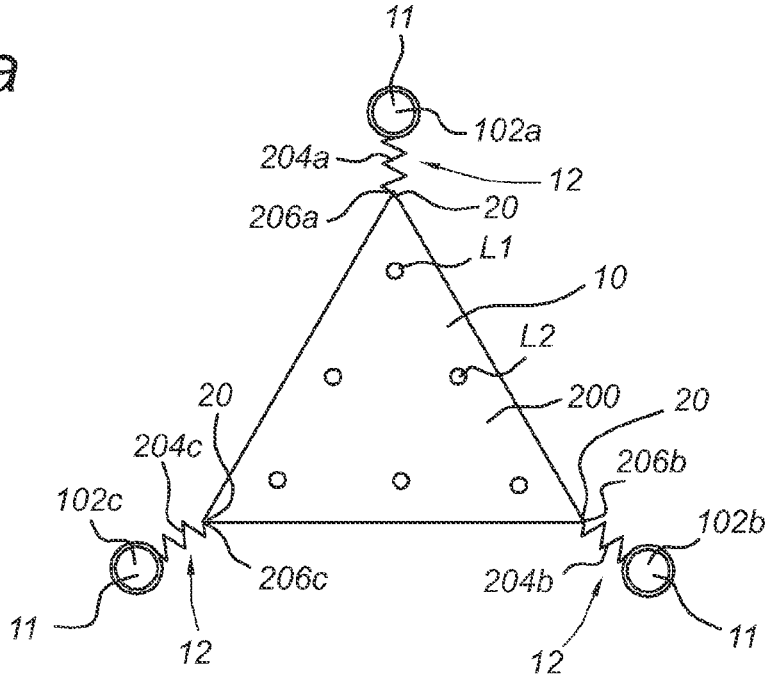
Figure 6B:
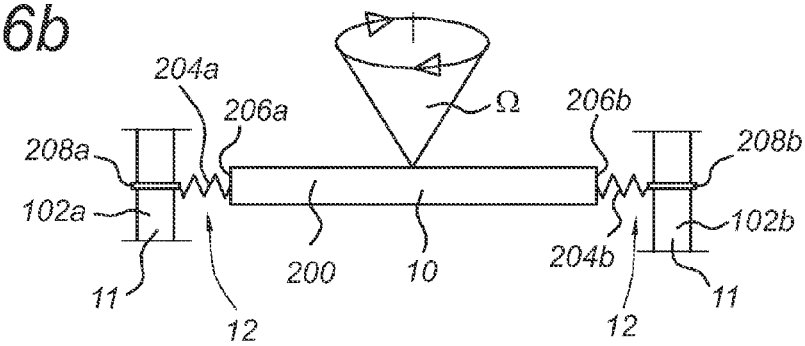

FIGS. 6*a* and 6*b* shows a second variant of an element 10 with its adjustable connections 12 to respective supports 11, shown as three supports 102*a*, 102*b* and 102*c*. FIGS. 6*a* and 6*b* show an element 10 in the form of a triangular-shaped element 200, carrying a plurality of light sources L1, L2, L3 etc. distributed over its surface. The triangular-shaped element 200 may form a board extending from a first end 206*a* to a second end 206*b* and a third end 206*c*, the ends corresponding to corners of the triangle. The first end 206*a* is connected with a resilient element 204*a* and movable part 208*a* to its respective support 102*a*. The resilient element 204*a* and the movable part 208*a* thus provide the adjustable connection 12 to support 102*a*. Similarly, second end 206*b* and third end 206*c* are connected with adjustable connections 12 comprising respective resilient elements 204*b*, 204*c* and movable parts to respective supports 102*b*, 102*c*. The adjustable connections 12 at the three ends 206*a*, 206*b*, 206*c* can thus be adjustably positioned relative to the supports 102*a*, 102*b*, 102*c* by moving the movable parts 208*a* along the supports 102*a*, 102*b*, 102*c*. By moving the three movable parts to different positions along the three respective supports, a solid angle Ω of the triangular-shaped element 200 relative to the three supports can be adjusted.

Figure 6C:
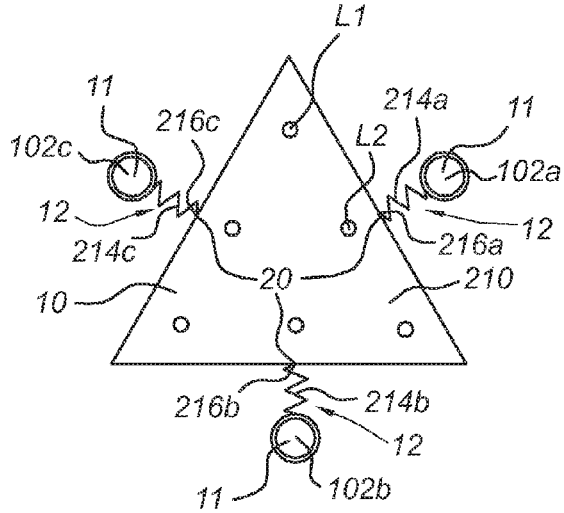

FIG. 6*c* shows another embodiment of an element 10 in the form of a triangular-shaped element 210. Triangular-shaped element 210 differs from triangular-shaped element 200 in that the ends now correspond to positions along the sides of the triangular shape. That is to say, the first end 216*a* corresponds to a middle position along a side of the triangular shape. The first end 216*a* is connected with a resilient element 214*a* and a movable part to its respective support 102*a*. The other ends 216*b*, 216*c* are also provided so as to correspond to middle positions of the other two sides of the triangle, and are connected to their respective supports 102*b*, 102*b*, using adjustable connections 12 with resilient elements 214*b*, 214*c* and corresponding movable parts (not shown).

Instead of a board, also a frame may be applied. A frame may consist of a plurality of bars, in general three or more, connected to each other (see also FIG. 7*b*).

Figure 7A:
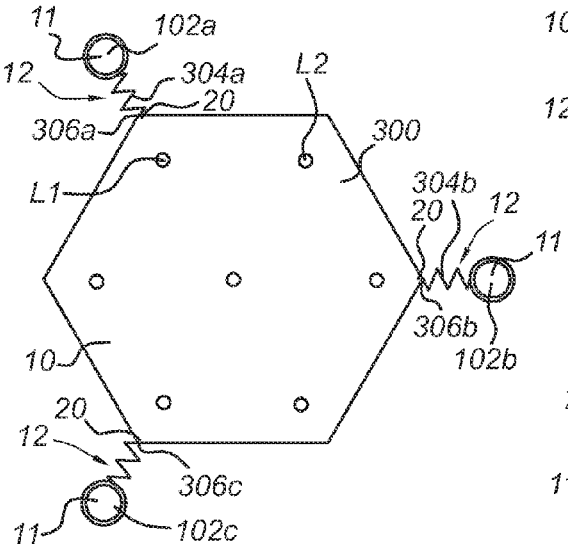

FIG. 7*a* shows a third variant of an element 10 with its adjustable connections 12 to respective supports 10 (shown as supports 102*a*, 102*b* and 102*c*). FIG. 7*a* shows an element 10 in the form of a hexagonal-shaped element 300, carrying a plurality of light sources L1, L2, L3 distributed over its surface. The hexagonal-shaped element 300 forms a board extending from a first end 306*a* to a second end 306*b* and a third end 306*c*, the ends corresponding to three of the six corners of the hexagon. The first end 306*a* is connected with a resilient element 304*a* and a movable part (not shown) to its respective support 102*a*. The resilient element 304*a* and the movable part thus provide the adjustable connection 12 to support 102*a*. Similarly, second end 306*b* and third end 306*c* are connected with adjustable connections comprising respective resilient elements 304*b*, 304*c* and movable parts to respective supports 102*b*, 102*c*. The adjustable connections 12 at the three ends 306*a*, 306*b*, 306*c* can thus be adjustably positioned relative to the supports 102*a*, 102*b*, 102*c* by moving the movable parts along the supports 102*a*, 102*b*, 102*c*. By moving the three movable parts at different positions along the three respective supports, a solid angle Ω of the hexagonal-shaped element 300 relative to the three supports can be adjusted.

Figure 7B:
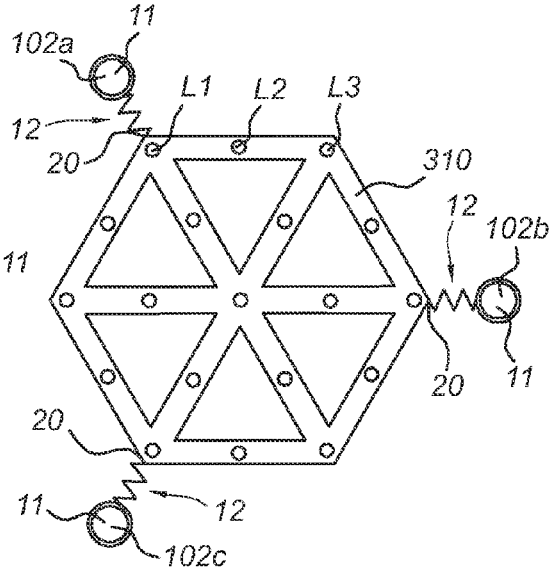

FIG. 7*b* shows another embodiment of an element 10 in the form of an hexagonal-shaped element 310. Hexagonal-shaped element 310 differs from hexagonal-shaped element 300 in that it does not form a board but instead forms a frame. Using a frame has the advantage that it comprises less material than a board of the same size.

Figure 7C:
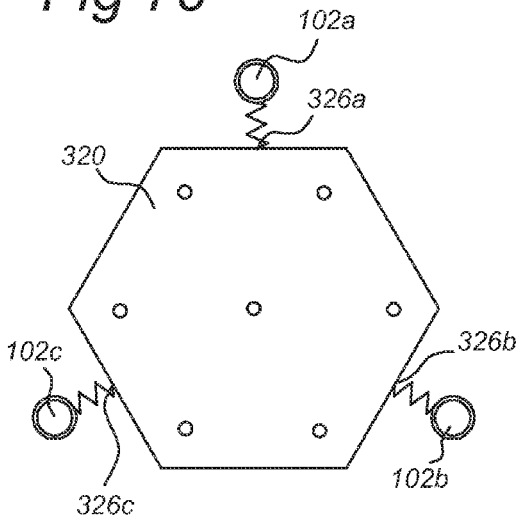

FIG. 7*c* shows yet another embodiment of an element 10 in the form of a hexagonal-shaped element 320. Hexagonal-shaped element 320 differs from hexagonal-shaped element 300 in that the ends 326*a*, 326*c*, 326*c* now correspond to positions along three of the six sides of the hexagonal shape.

Figure 8A:
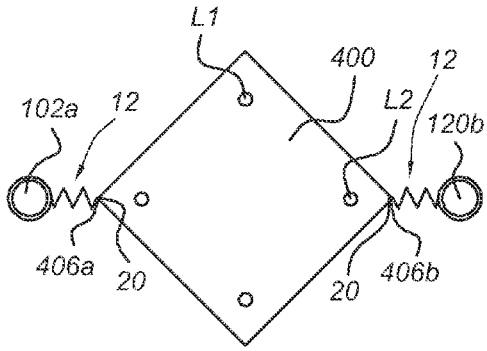

FIG. 8*a* shows a fourth variant of an element 10 with its adjustable connections 12 to respective supports 11 (shown as supports 102 and 102*b*). FIG. 8*a* shows an element 10 in the form of a square-shaped element 400, carrying a plurality of light sources L1, L2, L3 distributed over its surface, which may e.g. be used in a square lattice. The square-shaped element 400 forms a board extending from a first end 406*a* to a second end 406*b*, the ends corresponding to two of the four corners of the square. The first end 406*a* is connected with a resilient element 404*a* and a movable part (not shown) to its respective support 102*a*. The resilient element 404*a* and the movable part thus provide the adjustable connection 12 to support 102*a*. Similarly, second end 406*b* is connected with adjustable connection 12, comprising a resilient element 404*b* and a movable part, to its respective supports 102*b*. The adjustable connections at the two ends 406*a*, 406*b* can thus be adjustably positioned relative to the supports 102*a*, 102*b* by moving the movable parts along the supports 102*a*, 102*b*. By moving the two movable parts to different positions along the respective supports 102*a*, 102*b*, an angle α of the square-shaped element 400 relative to both supports 102*a*, 102*b* can be adjusted.

Figure 8B:
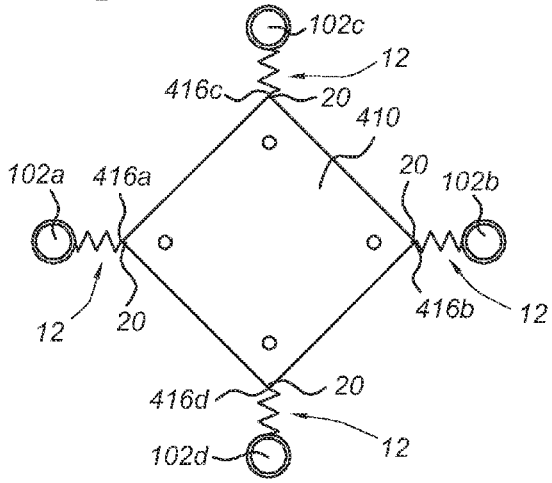

FIG. 8*b* shows another embodiment of a square-shaped element 410. Square-shaped element 410 differs from square-shaped element 200 in that all four corners of the square now correspond to ends 416*a*, 416*b*, 416*c*, 416*d* with adjustable connections to respective supports 102*a*, 102*b*, 102*c*, 102*d*. By moving the four movable parts to different positions along the four respective supports, a solid angle Ω of the square-shaped element 400 relative to the four supports can be adjusted.

Figure 8C:
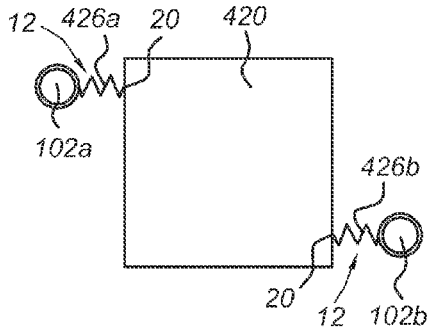

FIG. 8*c* shows yet another embodiment of a square-shaped element 420. Hexagonal-shaped element 420 differs from square-shaped element 400 in that the ends 426*e*, 426*f* now correspond to positions along two of the four sides of the square. The positions may correspond to the middle position along opposite sides of the square. In the example drawn, however, the positions correspond to positions in between the middle positions and the corners.

Aspects of further and alternative embodiments are described below with reference to elements 10 in the form of bar-shaped elements 100. It will be appreciated that some of these aspects apply similarly to elements of other shapes, such as the triangular elements 200, 210, the hexagonal elements 300, 310, 320 and the square-shaped elements 400, 410, 420 described above.

Figure 9A:
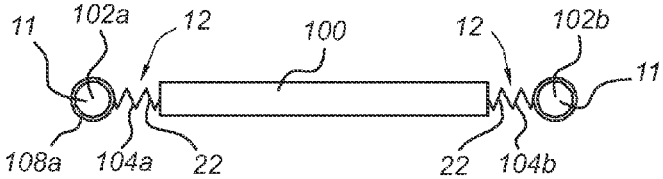
Figure 9B:
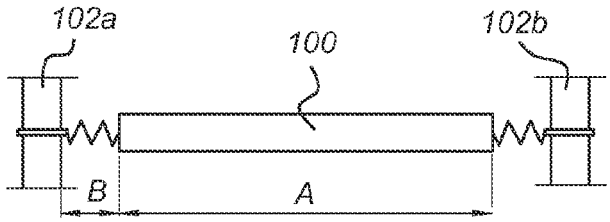
Figure 9C:
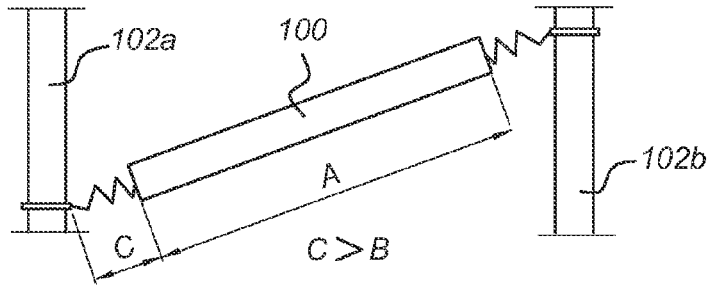

FIGS. 9*a*, 9*b* and 9*c* show a first embodiment of another aspect of elements with respective adjustable connections to respective supports. FIGS. 9*a*-9*c* show a rigid element 100, carrying three light sources L1, L2, L3. The rigid element 100 extends at least from a first end 106*a* to a second end 106*b*. The first end 106*a* is connected with its resilient element 104*a* and a movable part 108*a* to its respective support 102*a*. The resilient element 104*a* and the movable part 108*a* thus provide the adjustable connection to support 102*a*. Movable part 108*a* can be adjustably positioned along the support 102*a*. The second end 106*b* is connected with a resilient element 104*b* and a movable part 108*b* to its respective support 102*b*. The resilient element 104*b* and the movable part 108*a* b thus provide the adjustable connection to support 102*b*. Movable part 108*b* can be adjustably positioned along the support 102*b*. By moving the movable parts 108*a* and 108*b* to different positions along the respective supports 102*a*, 102*b*, an angle α of the bar-shaped element 100 relative to both supports can be adjusted. The rigid element has a length A. In a first position relative to both supports, the resilient elements 104*a*, 104*b* have a length B, as shown in FIG. 9*b*. When moving the resilient elements 104*a*, 104*b* to mutually different positions along the respective supports, the resilient elements 104*a*, 104*b* stretch to a length C, as shown in FIG. 9*c*, thus accommodating for the change of distance between the two supports in a direction along the element 100.

Figure 10A:
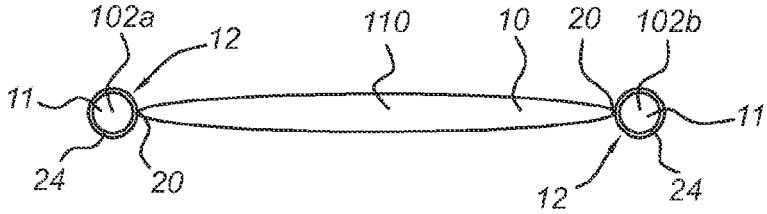
Figure 10B:
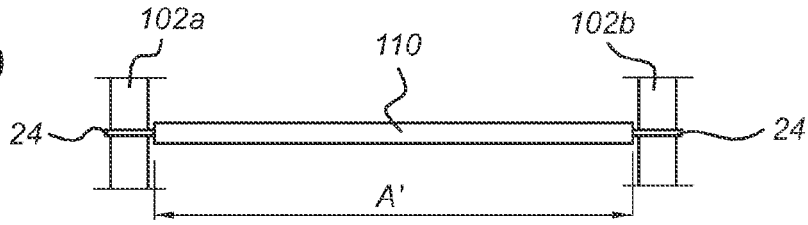
Figure 10C:
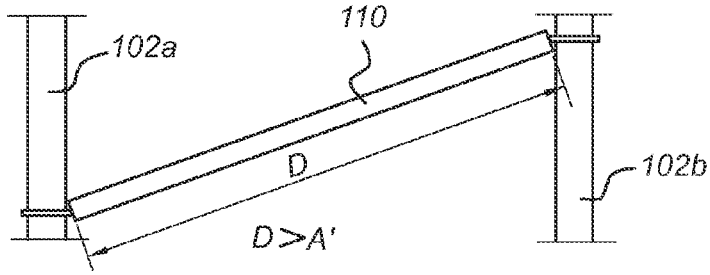

FIGS. 10*a*, 10*b* and 10*c* show a second embodiment of the other aspect of elements with respective adjustable connections to respective supports. FIGS. 10*a*-10*c* show an extensible element 110, carrying three light sources L1, L2, L3. The extensible element 110 may e.g. be a telescopic element or an elastic element. In a first position relative to both supports, the extensible element 110 has a length A', as shown in FIG. 10*b*. When moving the extensible element 110 with its adjustable connections to mutually different positions along the respective supports, the extensible element 110 stretches to a length D, as shown in FIG. 10*c*, thus accommodating for the change of distance between the two supports in a direction along the element 110.

Figure 11A:
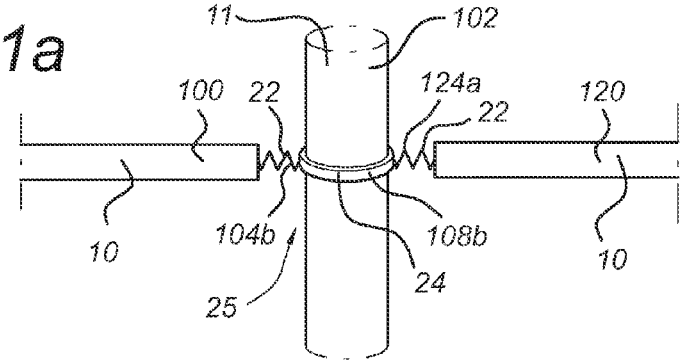
Figure 11B:
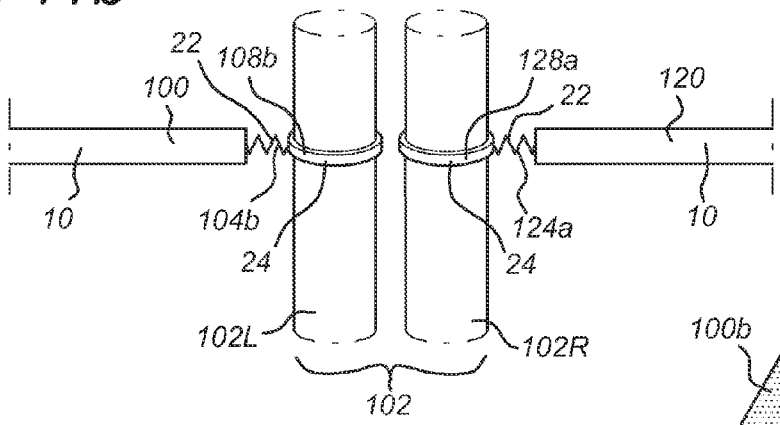

FIGS. 11*a* and 11*b* show alternative embodiments of adjustable connections of adjacent elements 10. FIG. 11*a* and FIG. 11*b* again show bar-shaped elements, denoted with reference numbers 100 and 120, but it will be understood that differently shaped elements may be applied alternatively and analogously. FIG. 11*a* shows a common adjustable connection 25. The common adjustable connection 25 comprises movable part 24 as a common movable part 108*b* and two resilient elements 22, individually numbered as 104*b* and 124*a*. The common adjustable connection 25 connects both elements 100 and 120 with the respective resilient elements 104*b* and 124*a* to the support 102 arranged on the grid. Moving the movable part 108*b* along the support thus results in a simultaneous adjustment of both elements 100 and 120 relative to the support 102. FIG. 11*b* shows adjustable connections 22 in the form of independent adjustable connections connecting neighboring elements 100 and 120 with respective resilient elements 22, individually numbered as 104*b* and124*a*, and moving parts 24, individually numbered as 108*b* and 128*a*, to the support 102. In the example shown, the support 102 comprises two support parts 102L and 102R at a close distance. Moving the movable parts 108*b* and 128*a* along the support may thus result in an independent adjustment of both elements 100, 120 relative to the support 102.

Figure 12A:
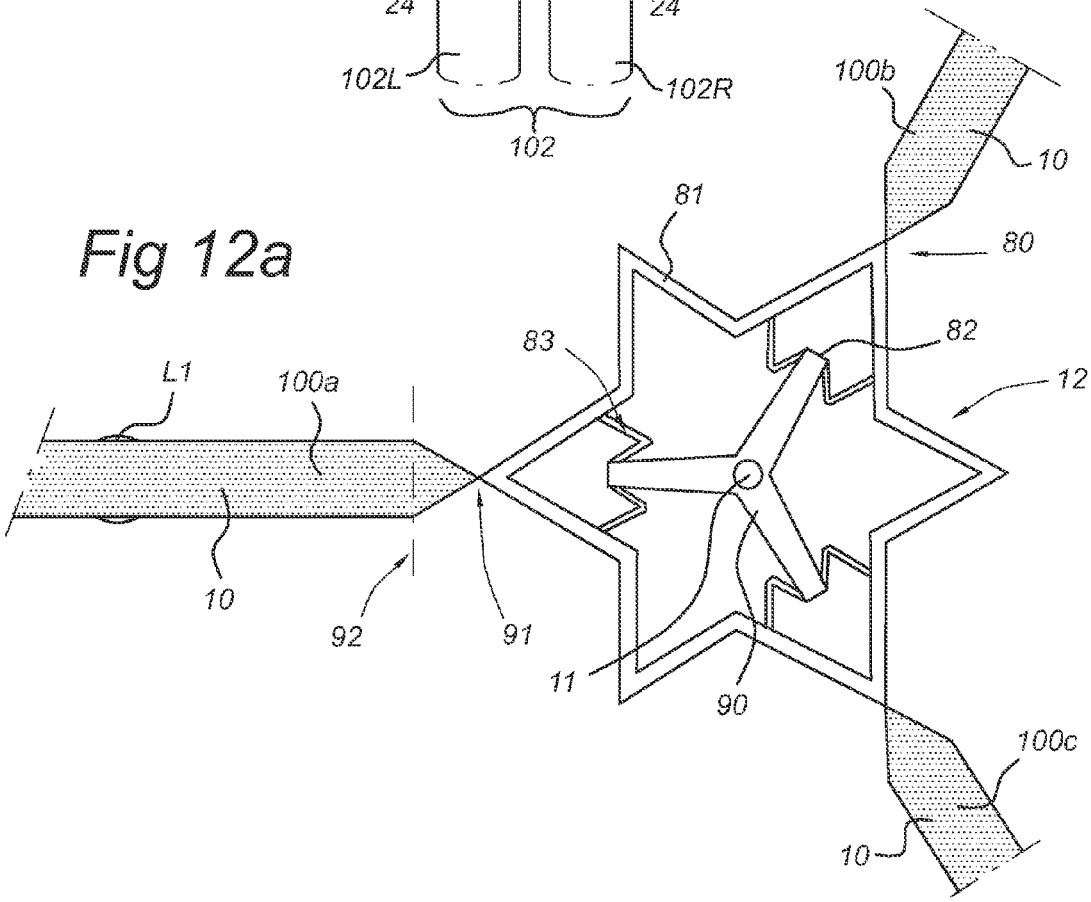
Figure 12B:
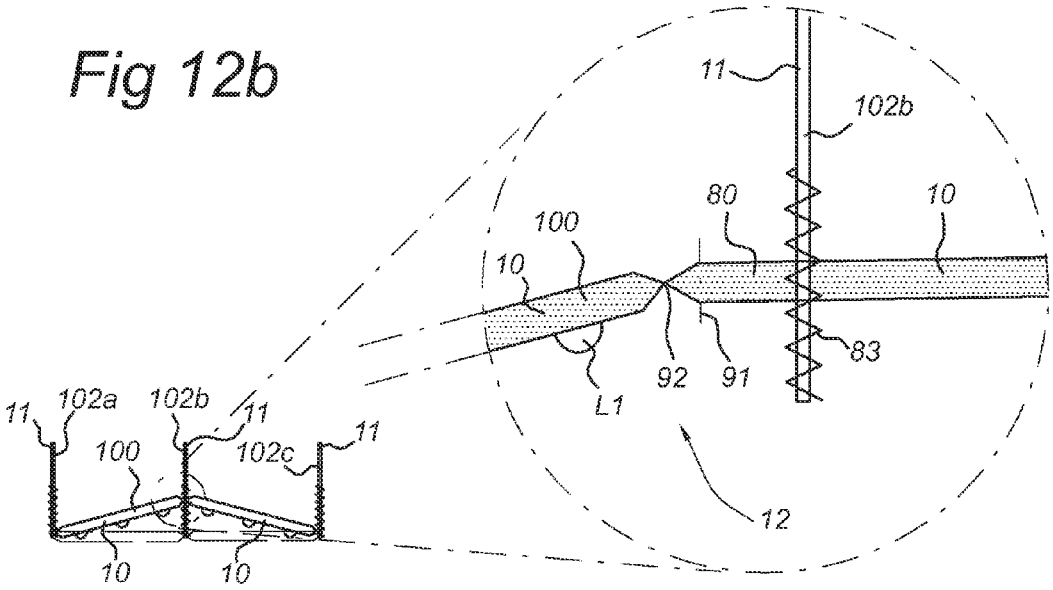

FIGS. 12*a* and 12*b* show a top view and a side view, respectively, of an embodiment of adjustable connection 12 in the form of an adjustable connection piece 80 connecting to a support 11 (here also numbered as 102*b*). The adjustable connection piece 80 of FIGS. 12*a* and 12*b* can be provided as a single device integrating the functions of the resilient element and of the movable part. The adjustable connection piece 80 of FIGS. 12*a* and 12*b* connects three elements 10, individually numbered as 100*a*, 100*b* and 100*c*, to the support 102*b*. The support 102*b* extends through a hole in a centre 90 in the adjustable connection piece 80. The adjustable connection piece 80 comprises an outer star-shaped contour 81, an inner star-shaped contour 82 and spring elements 83. The inner star-shaped contour 82 has three legs connecting the centre 90 via the spring elements 83 to the outer star-shaped contour 81. When the adjustable connection piece 80 moves along the support, the spring elements 83 thus provide the change in distance due to the change in angle of the associated element with respect to the support. Moreover, the spring elements 83 may accommodate for some degree of rotation of the outer star-shaped contour 81 relative to the inner star-shaped contour 82, allowing a further compensation of the distance with some degree of pivoting movement around axis 91. A further pivoting movement around axis 92 accounts for the angular displacement between element 100*a* and the adjustable connection piece 80.

Figure 13A:
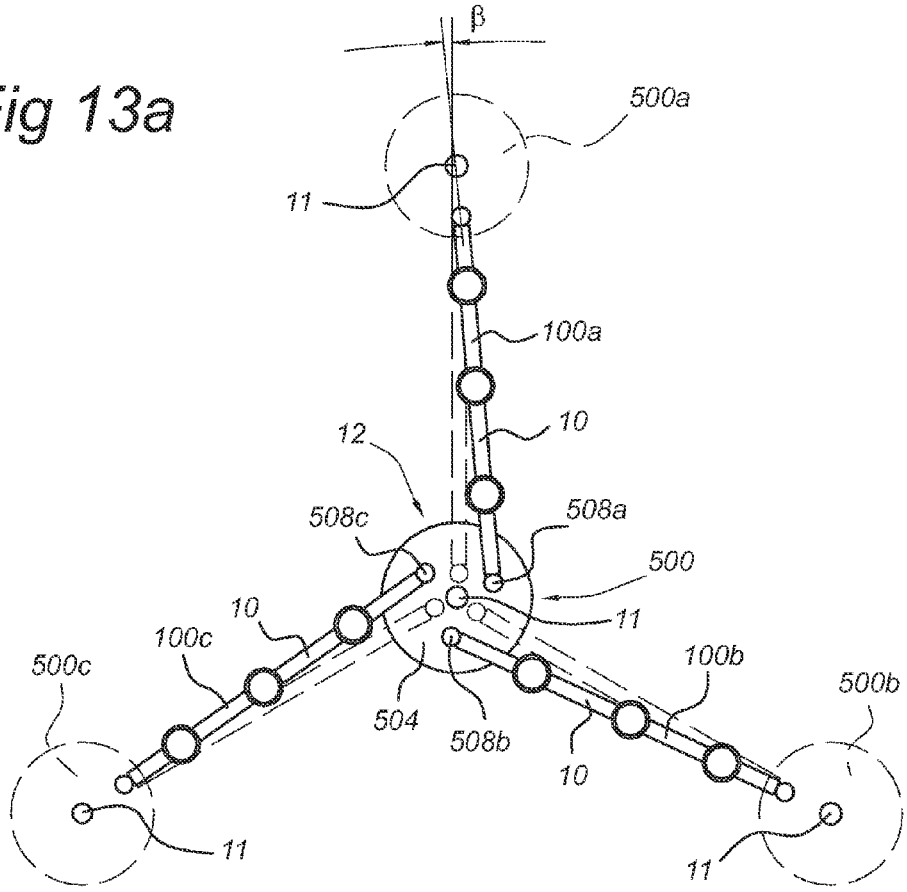
Figure 13B:
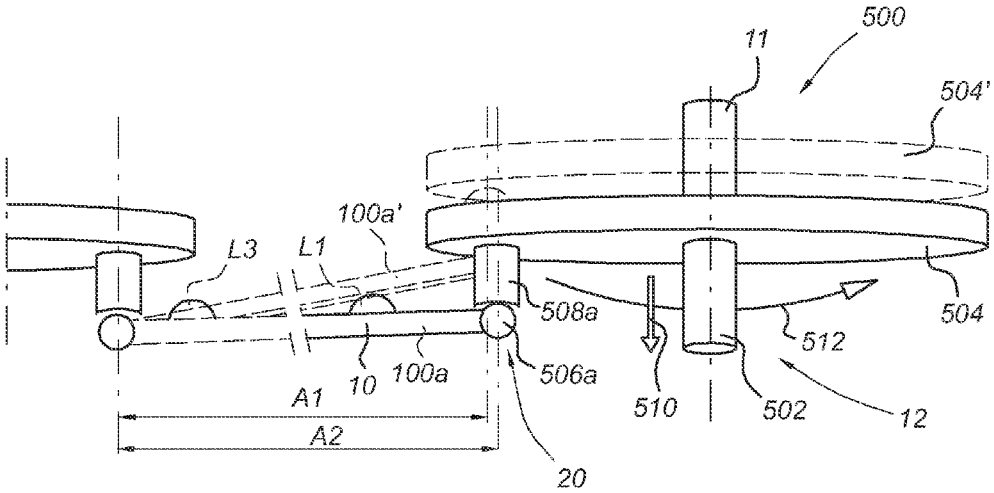

FIGS. 13*a* and 13*b* show a top view and a side view, respectively, of an alternative adjustable connection 12 in the form of a turntable device 500, which uses only rigid parts, connecting to a support 11. The turntable device 500 comprises a turntable 502, which can rotate around a centre axis 502 corresponding to a support 102*b*. The turntable 502 frictionally engages the axis 502, in order to prevent accidental rotation when it is not operated by a user or a motor. The turntable 502 of the turntable device 500 is connected to three elements 10, individually numbered as 100*a*, 100*b* and 100*c*, which are also connected to similar turntable actuators 500*a*, 500*b*, 500*c* at neighboring supports 11 on the grid. The elements comprise light sources L1, . . . , L3. Element 100*a* has a ball-and-socket joint 506*a* at its end 20, connecting via a stand 508*a* to the turntable 504. The other elements 100*b*, 100*c* are likewise connected to the turntable 504: FIG. 13*a* indicates the corresponding positions of stands 508*b*, 508*c*. When the turntable 502 is rotated around the axis 502 in a direction 512, the turntable 504 moves along the axis 502, e.g. to another position indicated as 504' in FIG. 13*b*. The axis 502 may e.g. be externally provided with a thread with a relatively large pitch, for converting the rotational movement into a linear movement along the support 102*b*. The relative position of element 100*a* will thus change: the other position of the turntable 504' is associated with another relative position of element 100*a*, indicated as 100*a* ', and indicated with dashed lines in FIGS. 13*a* and 13*b*. The rotation of the turntable 504 will thus not only change the relative angle of the element 100*a* with respect to the support 102*b*, but will also change the projected distance between the other end of the element and the ball-and-socket joint 506*a*, as is indicated with projected distances A1 and A2 in FIG. 13*b*. This change in projected distance compensates for the change in relative angle, and thus provides an adjustable connection with rigid parts only. The turntable actuators 500, 500*a*, 500*b*, 500*c* may be operated with respective actuators, e.g. comprising a piezo actuator, a pneumatic actuator, or a motor acting e.g. on the axis 502. The actuators may be controlled by a controller for accurately positioning the actuators and hence the relative positions of the elements 100*a*, 100*b*, 100*c*. As indicated in FIG. 13*a*, the turntable may be provided e.g. as a circular disk, or as a triangular element. It will be appreciated that other shapes may also be applied.

Figure 14:
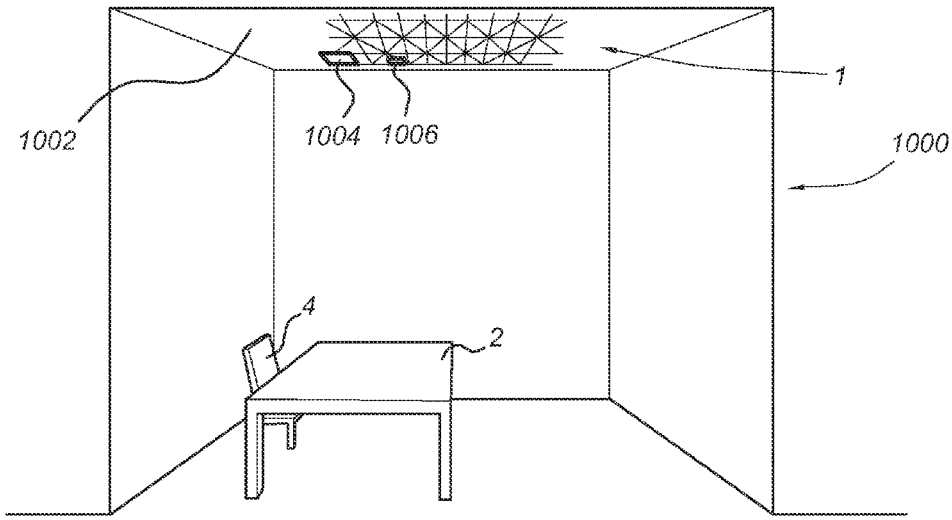
FIG. 14 schematically depicts an embodiment of a space according to the invention.

FIG. 14 shows a space 1000 comprising a lighting system 1 according to the invention. The lighting system 1 is attached to a ceiling 1002 of the space. A table 2 and chair 4 are positioned in the space. The positions of the table 2 and the chair 4 may be changed. Also, the number of tables and chairs may be changed, e.g. to accommodate visitors when the space is a living room or to provide additional work spaces when the space is an office space.

The lighting system 1 may further be connected to a controller 1004, which may be arranged external to the lighting system 1, e.g. on the ceiling 1002 itself, but which may also be integrated in the lighting system 1. The controller 1004 is especially arranged to control the lighting system 1, and more especially the individual light sources on different elements of the lighting system, or even the individual light sources on a single element of the lighting system 1. One or more of color, pattern shape, on/off state, and output intensity of the lighting system 1 may be variable and may be controlled by the controller.

Further, one or more of color and pattern shape of the illumination profile generated by the lighting system 1 may be dependent on a sensor signal of a sensor 1006 (such as an approach sensor, a fire sensor, a smoke sensor, a thermal sensor, etc.), wherein the sensor is arranged to sense an object on or in an area that can be illuminated by the lighting system 1 or to sense a feature selected from the group consisting of smoke and heat, and wherein the controller 1004 is arranged to control one or more of color, on/off state, intensity and pattern shape of the illumination profile generated by the lighting system 1 in dependence on the sensor signal. Therefore, in yet another embodiment, the lighting system further comprises a sensor, such as an approach sensor or a smoke sensor or a thermal sensor, etc., which may be arranged external to the lighting system 1 but which may also be integrated in the lighting system 1. The term sensor may also refer to a plurality of sensors. Such a plurality of sensors may for instance be arranged to sense the same parameter (like the touch of a user) at different locations, or to sense different parameters (like the touch of a user and smoke, respectively).

In the drawings, less relevant features like electrical cables, etc. have not been shown for the sake of clarity.

The term "substantially" herein, such as in "substantially flat" or in "substantially consists", etc., will be understood by the person skilled in the art. In embodiments the adjective substantially may be removed. Where applicable, the term "substantially" may also include embodiments with "entirely", "completely", "all", etc. Where applicable, the term "substantially" may also relate to 90% or higher, such as 95% or higher, especially 99% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices used herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The term "and/or" includes any and all combinations of one or more of the associated listed items. The article "a" or "an" preceding an element does not exclude the presence of a plurality of such elements. The article "the" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting system comprising a plurality of elements adjustably connected to a plurality of supports arranged on a grid, each of the plurality of elements comprising a light source, each of the plurality of elements further comprising at least two adjustable connections, the adjustable connections connecting the corresponding element to respective supports and adjustably positioning the corresponding element relative to the respective supports, wherein at least part of the adjustable connections is provided with a resilient element for compensating a change of distance in a direction along the element between corresponding supports when the corresponding element is being adjustably positioned relative to respective supports.

2. The lighting system according to claim 1, wherein the adjustable connections are arranged to move along at least one of the respective supports.

3. The lighting system according to claim 1, wherein each of the plurality of elements extends from a first end of the respective element to at least a second end of the respective element, and the at least two adjustable connections are provided at the first end and at least the second end.

4. The lighting system according to claim 1, comprising a plurality of actuators arranged for actuating corresponding adjustable connections, for adjustably positioning the corresponding elements relative to respective supports.

5. The lighting system according to claim 1, wherein the elements are extentable.

6. The lighting system according to claim 1, wherein the plurality of elements are selected from the group consisting of bars, frames and boards.

7. The lighting system according to claim 6, wherein at least part of the total number of the plurality of elements have a substantially regular polygon shape.

8. The lighting system according to claim 1, wherein at least two elements of the plurality of elements connect to a single support and share a common adjustable connection to the single support.

9. The lighting system according to claim 1, wherein the light source comprises at least one light-emitting diode.

10. The lighting system according to claim 9, wherein the LEDs are provided at a density of at least 1 LED per 100 $cm^2$.

11. A method of providing an illumination profile using a lighting system according to claim 1, the method comprising adjustably positioning at least two of the plurality of elements relative to the respective supports, and wherein preferably defining the illumination profile is associated with concentrating light generated by the light sources on part of the plurality of elements to a plurality of working areas.

12. The lighting system according to claim 9, wherein the LEDs are provided at a density of at least 1 LED per 10 $cm^2$.

* * * * *